US005823439A

United States Patent [19]

Hunter et al.

[11] Patent Number: 5,823,439

[45] Date of Patent: Oct. 20, 1998

[54] POP-UP SPRINKLER WITH SHOCK ABSORBING RISER SPRING

[75] Inventors: Richard E. Hunter, La Jolla; Fred M. Danner, Vista, both of Calif.

[73] Assignee: Hunter Industries Incorporated, San Marcos, Calif.

[21] Appl. No.: 698,909

[22] Filed: Aug. 16, 1996

[51] Int. Cl.[6] ..... B05B 15/10

[52] U.S. Cl. ..... 239/205; 239/203; 239/204

[58] Field of Search ..... 239/200, 201, 239/203, 204, 205; 267/33, 167

[56] References Cited

U.S. PATENT DOCUMENTS

| | | | |
|---|---|---|---|
| 3,096,084 | 7/1963 | Osterhoudt | 267/33 X |
| 3,684,179 | 8/1972 | Fischer | 239/203 |
| 4,512,517 | 4/1985 | Manor | 239/206 |
| 4,869,471 | 9/1989 | Schwarz et al. | 267/33 |
| 5,299,786 | 4/1994 | Godin | 267/33 |
| 5,310,167 | 5/1994 | Noll, Jr. | 267/33 |
| 5,358,224 | 10/1994 | Balsells | 267/33 |

*Primary Examiner*—Andres Kashnikow
*Assistant Examiner*—Robin O. Evans
*Attorney, Agent, or Firm*—Michael H. Jester

[57] ABSTRACT

A sprinkler unit comprises a tubular housing having an inlet for connecting to a source of water, a tubular riser telescopically reciprocally mounted in the tubular housing and moveable from a retracted position within the housing to an extended position from the housing, the riser having an outlet having a nozzle for distributing a stream of water outward from the housing, a passage connecting the inlet to the outlet, a retraction spring normally biasing the riser to the retracted position, and a shock absorbing coating on the retracting spring for absorbing the shock of movement of the riser to the extended position.

20 Claims, 2 Drawing Sheets

POP-UP SPRINKLER WITH SHOCK ABSORBING RISER SPRING

BACKGROUND OF THE INVENTION

The present invention relates to irrigation sprinklers and pertains particularly to an improved shock absorption means for pop-up sprinklers.

The artificial distribution of water through irrigation systems is in wide use throughout the world today. One of the most widely used systems particularly for lawn areas and playing or athletic fields, is the sprinkler system wherein a plurality of sprinkler units are positioned about a land area for distributing water over the surface of the land area. One of the most popular sprinkler units currently in use is a pop-up gear driven rotary head that rotates about a generally vertical axis and covers either an arc segment or a full circle. Such units have a riser which is retracted into an underground housing when not in use, and extends above the ground surface when in use. They typically employ a water driven turbine connected through a reduction drive bear train to the sprinkler head in which a nozzle is mounted to direct a stream of water outward in an arc or circle about the rotary axis of the sprinkler unit.

Sprinkler units of this type, particularly larger units are widely used in irrigation systems used on golf courses and other turf applications. These systems are usually high pressure so that the sprinkler units are frequently subjected to extreme forces over their lifetime of use which can damage them and reduce their useful life. The most serious of these forces result from water hammer and high pressure surges that occur during system winterization and spring recharge. These high forces are especially prevalent when empty pipes are being filled with water. Slugs of water accelerate down the length of the pipe, which pops open the valve in the bottom of the sprinkler body and slams the riser including the rotor up to the end of its stroke against the top of the housing. Due to the pressures and large pipe sizes for large turf applications these forces can be extremely high and frequently cause failure of the rotors. Attempts to solve this problem by making the sprinkler units heavier and stronger has been unsatisfactory because of increased costs. The dual medium of water and air has prevented the use of slow opening valves that use the control of the flow out from being successful. Accordingly, there is a need for means for reducing or eliminating the aforementioned forces to provide longer life sprinkler units.

Accordingly, it is desirable that a sprinkler unit be available having means for reducing or eliminating the aforementioned forces to provide longer life sprinkler units.

SUMMARY AND OBJECTS OF THE INVENTION

Accordingly, it is a primary object of the present invention to provide a sprinkler unit having an improved riser damping or shock absorbing means for absorbing the shock of the riser impact and reducing high forces normally resulting from high velocity forces 011 the riser and housing.

In accordance with the primary aspect of the present invention, a sprinkler unit is provided with means for (damping) absorbing the shock of the impact of the riser in response to inlet air and water and forces generated thereby for extending the life of the unit.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
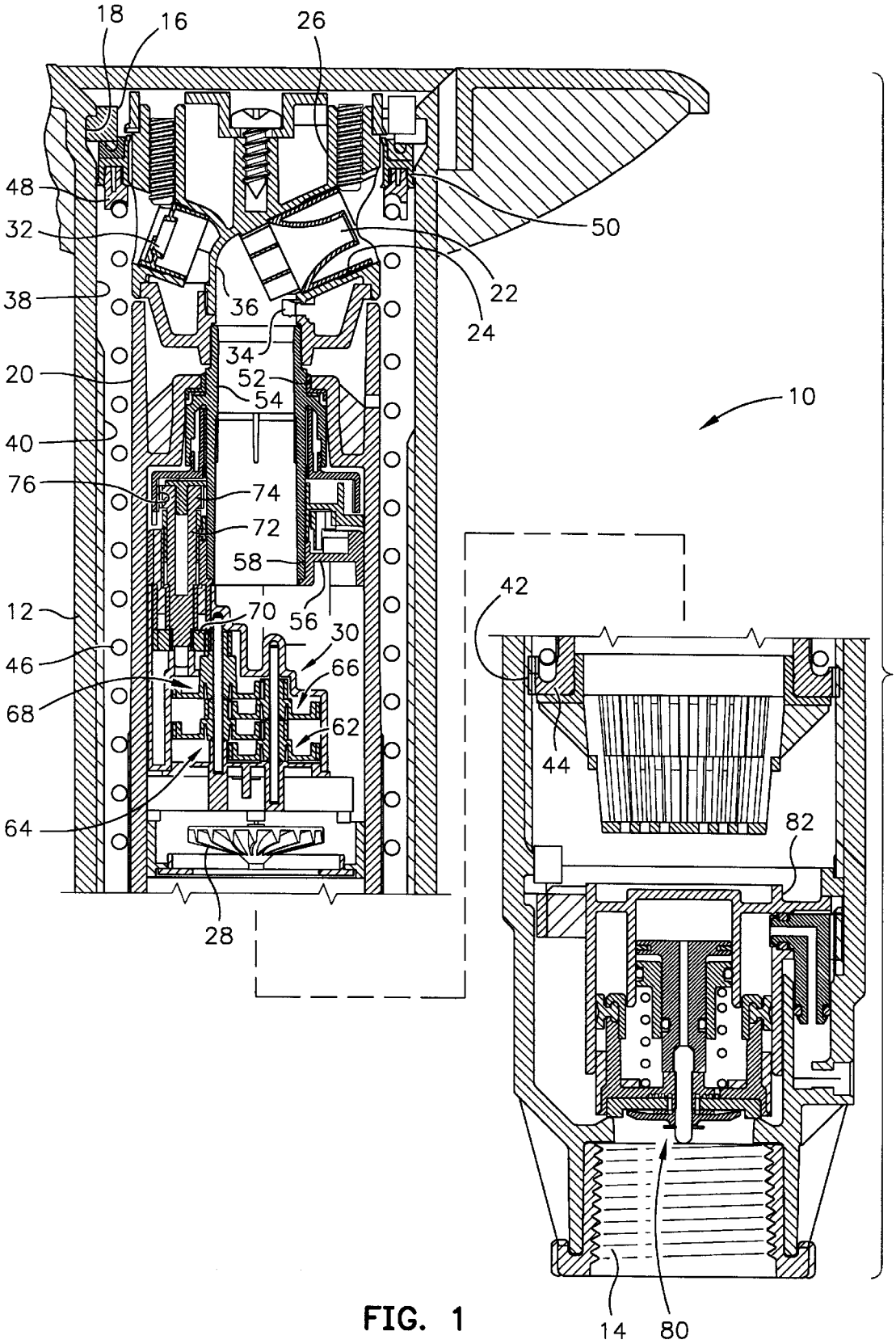
FIG. 1 is a split vertical section view of a sprinkler unit embodying a preferred embodiment of the invention.

Referring to the drawings, particularly to FIG. 1 there is illustrated a split vertical section view of a sprinkler unit embodying the present invention, and designated generally by the numeral 10. The sprinkler unit comprises a generally cylindrical tubular outer housing 12, having an inlet opening 14 at one end threaded for mounting to the end of a riser or the like for a source of pressurized water. An outlet end, which is normally disposed and oriented to be the top of the unit is provided with a suitable retaining ring 16 detachably mounted therein by means of an annular recess 18 for retaining a retractably mounted inner housing or riser 20 in a suitable manner.

Figure 2:
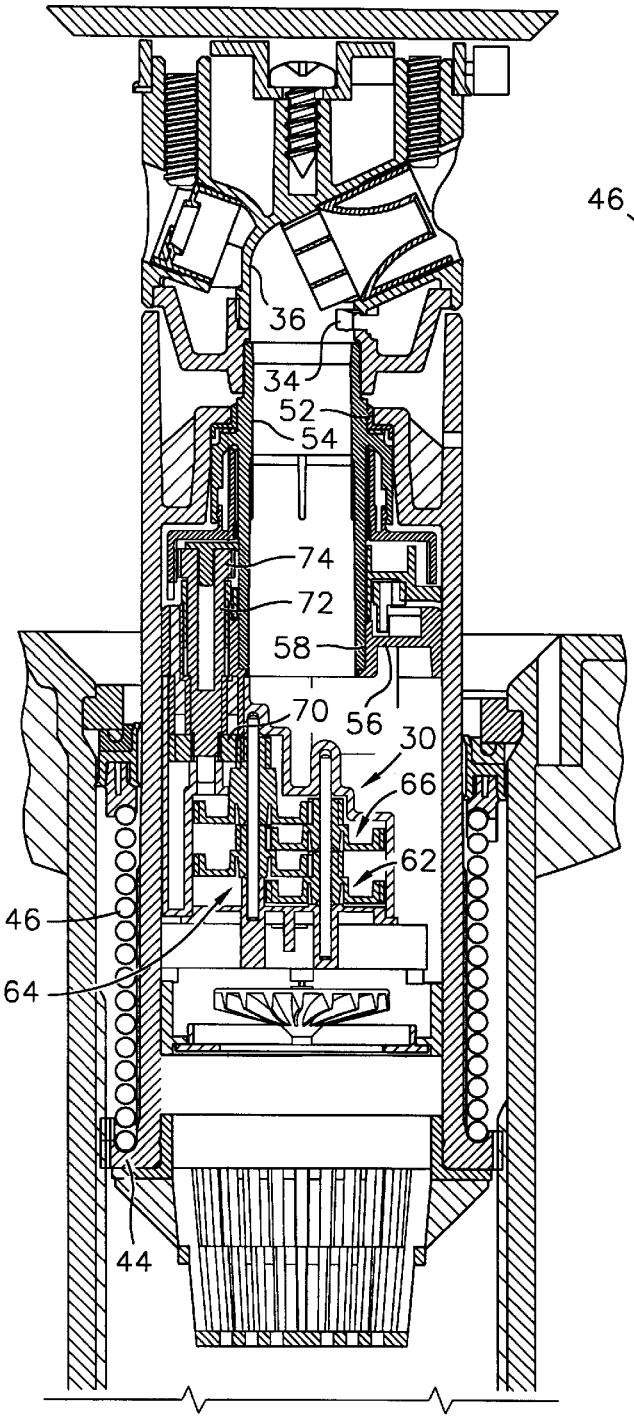
FIG. 2 is a detailed partial view of the unit of FIG. 1 showing the riser in the fully extended position.
Figure 3:
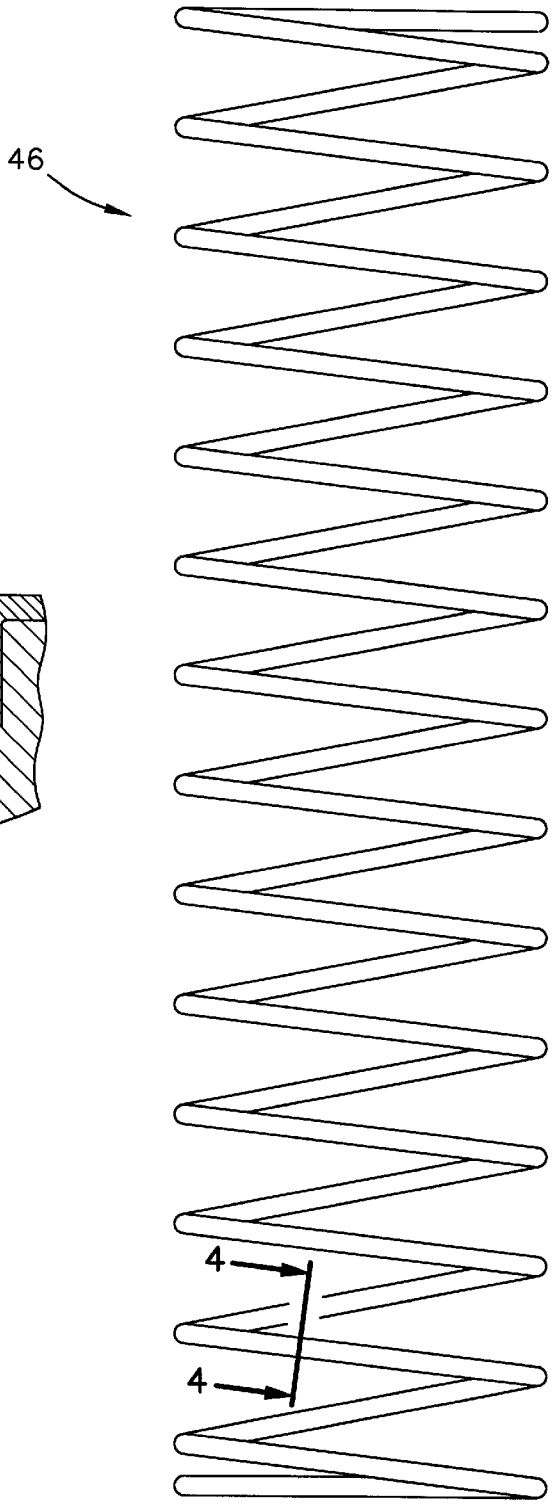
FIG. 3 is a side elevation section view of the retraction spring.

The inner tubular housing 20 is retractably mounted in the outer housing 12 for extension upward therefrom as shown in FIG. 2 and includes a nozzle 22 mounted in an upper or outer end thereof for distributing a stream of water therefrom. The nozzle is mounted in a passage or socket 24 in a rotatable head 26 and rotatably driven by means of turbine 28 through a reduction gear drive gear train designated generally at 30, as more fully described herein below. The particular unit illustrated is designed for golf course and playing field use and to rotate in a part or full circle about a central axis of the housing. A second nozzle 32 is shown mounted in the head opposite the nozzle 22 and communicates via a port 34 with a through passage 36 to improve the distribution of the stream of water closer in to the unit.

The inner housing or riser 20 is retractably mounted within a bore 38 of the outer housing 12, and is oriented by internal ribs 40 and by means of teeth 42 on radial flange 44 at the lower end thereof. An elongated coil compression spring 46 engages shoulder or flange 44 at the lower end of inner housing 20, and is confined within the bore by means of ring 16 at the upper end. The inner housing, or riser 20 is normally biased to the lowermost or retracted position as illustrated in FIG. 1 when water pressure is shut off. The terms inner housing and riser are used interchangeably herein.

The inner housing 20 is provided with retracting means in the form of coil compression spring 46, which biases the inner housing to the retracted position (FIG. 1) when water pressure is shut off. The spring 46 is positioned between the annular flange 44 and a ring 48 at the upper end of the housing 12, which biases against outer annular seal assembly 50 retained in position by the retaining ring 16.

The inner housing 20 serves as a riser and carries the rotating head 26 from its retracted position in the outer housing 12, as shown in FIG. 1, to an extended position above the ground surface as shown in FIG. 2, where the head rotates and distributes water. The inner housing 20 converges at the top with inwardly tapering walls to an opening 52 in which is rotatably mounted a tubular shaft 54, having an upper end extending above the upper end of housing 20 on which the rotating head 26 is mounted. The shaft 54 serves to mount the head 26 convey water from the inlet to the outlet nozzle and transfer torque from the drive train to the rotating head.

The driving assembly for rotating the head 26 is mounted in the inner housing 20 and includes support structure 56 having a journal 58 in which the lower end of the tubular shaft 54 is rotatably mounted. A shoulder surrounds opening 52 and is engaged by a shoulder on rotary shaft 54.

The turbine wheel 28 rotates in response to water flowing through the sprinkler unit and is mounted on a shaft which drivingly rotates a pinion gear which meshes with and drives a reduction gear unit 62 having a larger driven gear and a smaller pinion gear. The reduction gear unit 62 further drives a reduction gear unit 64 which in turn drives a reduction gear unit 66 further driving a reduction gear 68 unit. This reduction gear unit 68 is the final drive unit in the reduction drive assembly 30. This unit, as in previous embodiments, includes a larger driven gear and a smaller driving pinion.

This gear unit 68 falls at the end of the drive train for the reduction drive train for the turbine wheel 28. The gear unit 68 meshes with a gear 70 on a shaft 72 for driving a pinion 74 which in turn drives an internal ring gear 76 which is connected to and driving the tubular shaft 54.

An inlet check or flow control check valve assembly designated generally at 80 may be mounted at the inlet of the housing to aid in controlling the velocity of fluid entering the sprinkler unit. This valve assembly comprises a housing 82 which may or may not be integral with the sprinkler housing. The housing 82 is of a generally cylindrical configuration and positioned coaxially within the bore of housing 12 adjacent inlet 14.

Referring to FIG. 2, the riser 20 is shown in the fully extended position with the spring 46 in the fully compressed or bottomed position, i.e. the coils in engagement with one another which occurs when the system is pressurized. The typical spring is made of spring steel and has from about eight to about twelve coils and when collapsed to coil to coil engagement is hard and unyielding. Under normal operating conditions, when the water lines are normally full and the system pressurized the riser 20 will extend at a moderate rate to its extended position. However, when the lines are empty and being refilled, water may rush into the sprinkler unit at a high velocity forcing the riser 20 rapidly to its extended position where the coils of the riser return spring 46 engage one another or bottoms out with a high energy impact. This high impact is transmitted directly to the riser and housing and frequently damages the rotor assembly contained within the riser and/or the housing.

Figure 4:
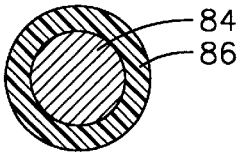
FIG. 4 is a view taken generally on line 4—4 of FIG. 3.

In accordance with the present invention, the return spring 46 is coated with a soft or yieldable plastic coating to absorb the shock of the impact when the riser bottoms out. As shown in FIG. 4, the spring comprises a central or core steel spring 84 with a soft or yieldable coating 86 of a plastic. When the spring is compressed coil to coil engagement, energy is absorbed by the plastic coating. This provides a simple and effective device that absorbs the energy of impact, reduces stress on the rotor and housing thereby increasing its service life.

We have found that a general purpose medium hard plastic of about 0.012 inches in thickness gives satisfactory results. Any number of suitable plastics including but not limited to polyvinylchloride (PVL), and Teflon elastomers may be used. We have found that a medium hardness in the range of 70 to 80 Durometers provide good results. Adherence of the coating to the spring is an important factor. The coating may also be applied in any number of ways such as spray, powder or dip. The typical spring for the average sprinkler unit has about ten (10) or more coils. Larger units may have twice that many. The additive effect of the coating of the many coils provides good energy absorption.

While we have illustrated and described our invention by means of specific embodiments, it should be understood that numerous changes and modifications may be made therein without departing from the spirit and scope of the invention as defined in the appended claims:

We claim:

1. A sprinkler unit comprising:

a tubular housing having an inlet for connecting to a source of water;

a tubular riser telescopically reciprocally mounted in said tubular housing and moveable by water pressure from a retracted position within said housing to an extended position from said housing, said riser having an outlet for distributing a stream of water outward from said housing, and a passage connecting said inlet to said outlet;

a retraction spring normally biasing said riser to said retracted position; and shock absorbing means on said retraction spring for damping movement of said riser to a bottomed position of said retraction spring at said extended position.

2. A sprinkler unit according to claim 1 wherein said shock absorbing means comprises a yieldable coating on said retraction spring.

3. A sprinkler unit according to claim 2 wherein said retraction spring is a coil spring surrounding said riser.

4. A sprinkler unit according to claim 3 wherein said yieldable coating is a general purpose medium hard plastic.

5. A sprinkler unit according to claim 4 wherein said yieldable coating has a thickness of about 0.012 inches.

6. A sprinkler unit according to claim 1 wherein said shock absorbing means is a coating which has a thickness of about 0.012 inches.

7. A sprinkler unit according to claim 6 wherein said coating is elastomeric.

8. A sprinkler unit according to claim 6 wherein said spring has from about eight to about twelve coils.

9. A sprinkler unit according to claim 1 wherein said spring has from about eight to about twelve coils.

10. A sprinkler unit according to claim 1 wherein:

said housing has a cylindrical bore;

said riser is reciprocally mounted in said bore and has a radial flange at a lower end thereof;

said retraction spring has a coil configuration surrounding said riser and engaging said flange; and said shock absorbing means comprises a yieldable coating on said spring.

11. A sprinkler unit according to claim 10 wherein said yieldable coating is a general purpose medium hard plastic.

12. A sprinkler unit according to claim 11 wherein said yieldable coating has a thickness of about 0.012 inches.

13. A sprinkler unit according to claim 12 wherein said spring has from about eight to about twelve coils and said coating has a thickness of about 0.012 inches.

14. A sprinkler unit according to claim 13 wherein said yieldable coating is elastomeric.

15. A sprinkler unit comprising:

a tubular housing having a cylindrical bore and an inlet for connecting to a source of water;

a tubular riser telescopically reciprocally mounted in said cylindrical bore and having a radial flange at a lower end thereof, said riser moveable by water pressure from a retracted position within said housing to an extended position from said housing, said riser having an outlet having a nozzle for distributing a stream of water outward from said housing, and a passage connecting said inlet to said outlet;

a retraction spring normally biasing said riser to said retracted position, said retraction spring having a coil configuration surrounding said riser and engaging said flange; and shock absorbing means including a yieldable coating on said retraction spring for damping bottoming out of said retraction spring upon movement of said riser to said extended position.

16. A sprinkler unit according to claim 15 wherein said yieldable coating is a general purpose medium hard plastic.

17. A sprinkler unit according to claim 16 wherein said yieldable coating has a thickness of about 0.012 inches.

18. A sprinkler unit according to claim 17 wherein said yieldable coating is elastomeric.

19. A sprinkler unit according to claim 17 wherein said spring has at least about eight coils.

20. A sprinkler unit according to claim 15 wherein said yieldable coating has a hardness of about 70–80 Durometers.

* * * * *